US005984767A

United States Patent [19]

Pineau et al.

[11] Patent Number: 5,984,767

[45] Date of Patent: Nov. 16, 1999

[54] ASSEMBLY USING AN ABRASIVE STRIP TO MACHINE A CYLINDRICAL BEARING SURFACE OF A WORKPIECE

[75] Inventors: Jean Claude Pineau, Chailly-en-Bière; Richard Bonachera, Vincennes, both of France

[73] Assignee: Societe des Procedes et Machines Speciales, Evry Cedex, France

[21] Appl. No.: 09/016,688

[22] Filed: Jan. 30, 1998

[51] Int. Cl.[6] ..... B24B 21/20

[52] U.S. Cl. ..... 451/302; 451/8; 451/49; 451/303; 451/310

[58] Field of Search ..... 451/8, 49, 302, 451/303, 307, 310

[56] References Cited

U.S. PATENT DOCUMENTS

| | | | |
|---|---|---|---|
| 799,442 | 9/1905 | Bornman | 451/302 |
| 1,502,130 | 7/1924 | St. Clair | 451/302 |
| 1,905,821 | 4/1933 | Dunbar et al. . | |
| 1,908,048 | 5/1933 | Player et al. . | |
| 4,140,456 | 2/1979 | Sato | 451/302 X |
| 4,145,846 | 3/1979 | Howland et al. | 451/302 X |
| 5,058,325 | 10/1991 | Pineau . | |
| 5,095,663 | 3/1992 | Judge et al. | 451/49 X |
| 5,437,125 | 8/1995 | Barton, II | 451/304 X |
| 5,522,762 | 6/1996 | Pineau . | |
| 5,531,631 | 7/1996 | Judge . | |
| 5,651,719 | 7/1997 | Pineau . | |
| 5,683,291 | 11/1997 | Humpert et al. | 451/8 X |
| 5,755,615 | 5/1998 | Kiriyama | 451/49 X |
| 5,775,974 | 7/1998 | Hulsebus | 451/304 X |
| 5,775,978 | 7/1998 | Brocksieper | 451/51 |

FOREIGN PATENT DOCUMENTS

| | | |
|---|---|---|
| 0219301 | 4/1987 | European Pat. Off. . |
| 0382336 | 8/1990 | European Pat. Off. . |
| 8602817 | 4/1986 | Germany . |
| 9620068 | 7/1996 | WIPO . |

*Primary Examiner*—Timothy V. Eley
*Attorney, Agent, or Firm*—Silber & Fridman

[57] ABSTRACT

A machining assembly consisting of first and second pivotal jaws opposing each other. A clamping arrangement is provided for clamping the jaws and to apply a flexible strip of abrasive material against the machined surface. The first jaw containing a shoe element having a rigid pressure surface. The second jaw carries two reaction members. The second jaw presses the strip of abrasive material against the bearing surface. The second jaw carries two measuring tips movably mounted thereon for measuring the bearing surface. A displacement arrangement for separating the measuring tips apart when said jaws are unclamped and bringing these tips together when said jaws are clamped.

8 Claims, 3 Drawing Sheets

ASSEMBLY USING AN ABRASIVE STRIP TO MACHINE A CYLINDRICAL BEARING SURFACE OF A WORKPIECE

BACKGROUND OF THE INVENTION

The present invention relates to an assembly using an abrasive strip to machine a cylindrical bearing surface of a workpiece, especially a journal and/or wrist pin of a crankshaft, of the type comprising two opposed jaws which can be clamped against the bearing surface to be machined in order to apply an abrasive strip against the latter while the workpiece is rotated.

Assemblies of this type are known, for example, from Utility Model DE 86 01 817. According to this document, each jaw carries two shoes for applying the abrasive strip, which are mounted elastically on the jaw and each extending over an angle of between 15 and 45° of the circumference of the bearing surface to be machined. This machining assembly has numerous drawbacks among which mention may be made, in particular, of the poor distribution of pressure over the four shoes, the limited angle of contact of the shoes, and therefore of the abrasive strip, with the bearing surface to be machined, and hence the fact that it is impossible to carry out machining which yields not only a good surface finish but also compensates for any defects in the shape of the bearing surface, and the absence of built-in means of checking the diameter of the bearing surface during machining.

Document FR-A-2 702 693 (=U.S. Pat. No. 5,522,762) discloses a machining assembly that involves three shoes for applying the abrasive strip, each extending over an angle of between 60° and 120° and arranged more or less at the three vertices of an equilateral triangle. This machining assembly, despite the advantages it yields over an assembly with four application shoes, is still not satisfactory as regards compensation for defects in the shape of the bearing surface to be machined.

Document FR-A-2 719 516 (=U.S. Pat. No. 5,651,719) relates to a machining assembly which employs the overall structure of the assembly according to the previous document, but is equipped with means of checking the diameter of the bearing surface while it is being machined.

Nevertheless, these known machining assemblies are unable fully to meet all the requirements imposed at the present time as regards in particular the machining of the journals and wrist pins of motor vehicle engine crank shafts.

The present invention is aimed at an assembly that uses an abrasive strip to machine a cylindrical bearing surface of a workpiece, especially a journal and/or a wrist pin of a crankshaft, which assembly, while being of a simple structure, optimally meets the requirements imposed in this field, from the machining precision point of view and that of compensating for defects in shape. The invention is also aimed at an assembly that uses abrasive strip to machine a cylindrical part of a workpiece, incorporating built-in means for checking the diameter of the bearing surface during machining.

The machining assembly in accordance with the invention that uses an abrasive strip to machine a cylindrical bearing surface of a workpiece, especially a journal or wrist pin of a crankshaft, comprises two opposed jaws which can be clamped against the bearing surface to be machined in order to press an abrasive strip against the latter as the workpiece is rotated. A first one of said jaws carries a shoe which has a rigid concave bearing surface in the shape of a sector of a cylinder of a shape that matches that of the bearing surface to be machined, with means for immobilizing an abrasive strip relative to said bearing surface during machining. The second jaw carries two reaction surfaces or pads spaced apart in the circumferential direction of the bearing surface to be machined and directed parallel to the bearing surface to be machined. The layout of the shoe of the first jaw and of the two reaction pads of the second jaw is such that when the jaws are clamped on the bearing surface to be machined, the shoe presses the abrasive strip against the bearing surface to be machined over a circumferential angle which is preferably between 120° and less than 180° and the two reaction pads are pressed directly against the bearing surface to be machined along two generatrices of the latter which are spaced apart by a circumferential angle which is preferably between 60° and 120°.

Within the context of the invention, the abrasive strip may be immobilized with respect to the bearing surface of the shoe by adhesive, the strip being stuck to the bearing surface, or preferably by controlled clamping means arranged on either side of the shoe, as close as possible thereto, which allows the abrasive to be renewed simply by moving the strip on between two machining operations.

The two reaction pads may be shoes, but in order to reduce the friction of the reaction pads on the bearing surface to be machined, it is advantageous for use to be made of two rollers mounted on the second jaw so that the axes of the rollers are parallel to the axis of the bearing surface to be machined.

Still with a view to reducing the friction of the reaction pads on the bearing surface to be machined, the reaction pads may have axial mobility with respect to their jaw. Thus, the reaction pads may, by friction, participate in the oscillatory movement in terms of axial translation that the bearing surface undergoes, in a way known per se, in addition to its rotation, while it is being machined by abrasive strip.

The machining assembly according to the invention may further comprise built-in means of checking the diameter of the bearing surface while it is being machined. In this case, in addition to the two reaction pads, the second jaw carries two measuring pads mounted so that they can move on the second jaw in such a way that they can be moved apart and brought closer together so as to be pressed, in the machining position, in diametrically opposed positions, against the bearing surface to be machined. The second jaw further advantageously comprises means for moving the two measuring pads apart when the jaws are not clamped and for bringing them closer together when the jaws are clamped.

Within the context of the invention, said means for moving the two measuring pads apart and bringing them closer together may be actuated directly by the opening and closing movement of the jaws, or alternatively be controlled as a function of this movement for parting them and bringing them closer together.

Two illustrative and nonlimiting embodiments of an assembly in accordance with the invention for machining using an abrasive strip will be described in greater detail below with reference to the appended diagrammatic drawing; in the drawing:

DESCRIPTION OF THE PREFERRED EMBODIMENT

Figure 1:
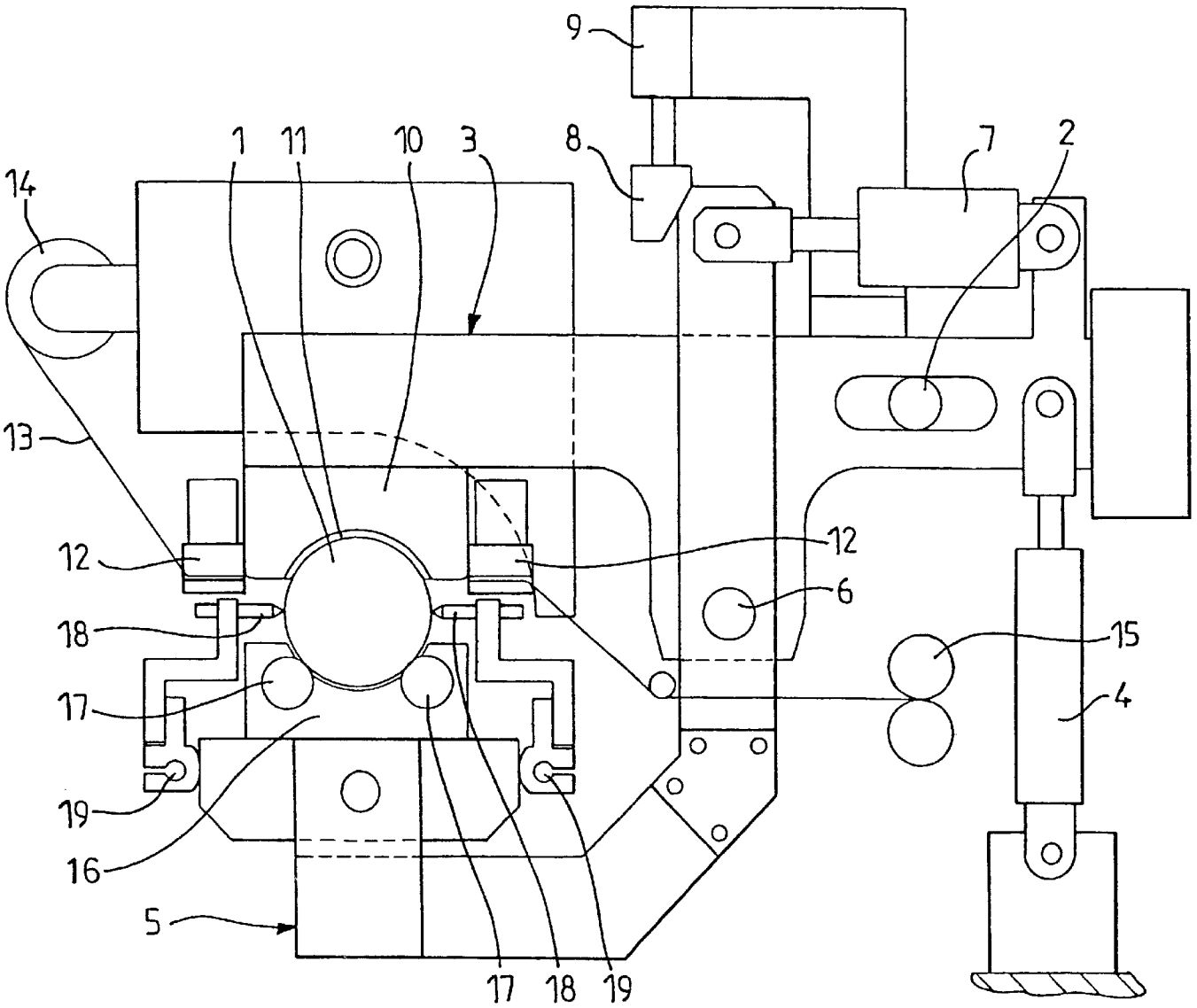
FIG. 1 shows a first embodiment of an assembly of the invention adapted for use on a workpiece having substantially horizontal orientation.

As illustrated in FIG. 1, a cylindrical bearing surface 1 of a workpiece is machined using an abrasive strip by means of a machining assembly which may form part of a machine tool comprising a number of assemblies for simultaneously machining a number of bearing surfaces on the same workpiece, for example a number of journals and/or wrist pins of a crankshaft. For further details regarding the overall structure and function of a machine of this kind, it is possible to refer, for example, to document FR-A-2 636 877 (U.S. Pat. No. 5,058,325).

The assembly essentially comprises a first jaw 3 which is mounted so that it can pivot about an axle 2, and a second jaw 5 which is mounted so that it can pivot about a horizontal axis 6 on the first jaw 3, the assembly being balanced by a balancing ram 4. It is illustrated in FIG. 1 that a ram or cylinder 7 clamps the jaws by raising the lower jaw 5 about its pivotal area 6. Upon clamping of the jaws, the ram or cylinder 9 acts on a wedge-shaped ramp 8. In turn, the ram 8 engages a wedge-shaped upper portion of the lower jaw 5. Such engagement prevents lowering or unclamping the lower jaw 5 until machining of the bearing surface is completed. This in particular makes it possible to improve the geometry of the bearing surface, it being impossible for the jaws to part in order to "negotiate" defects in the shape of the bearing surface during machining.

The first jaw 3 carries a shoe 10 which, on the side facing toward the bearing surface 1 to be machined, has a rigid concave bearing surface 11 in the shape of a sector of a cylinder of a shape that matches that of the bearing surface 1 to be machined, the axial length of the bearing surface 11 being shorter than the axial length of the bearing surface 1 to be machined. By way of example, the shoe 10 may be made of steel, the bearing surface 11 being precision ground. In the example depicted, the bearing surface 11 in the shape of a sector of a cylinder extends over a circumferential angle of about 130°.

On either side of the shoe 10, the jaw 3 carries a device 12 for clamping an abrasive strip 13 which, paid out from a supply 14 passes via the first clamping device 12, over the bearing surface 11 of the shoe 10, via the second clamping device 12 and from there onto a winding-on device 15.

The second jaw 5 carries a reaction support 16 which has a shape that more or less corresponds to that of the shoe 10 of the first jaw 3, but comprises two reaction rollers 17 mounted so that they can rotate on the support 16, their axes being parallel to the axis of the bearing surface 1 to be machined, so that the two rollers 17 protrude somewhat from the concave surface in the shape of a sector of a cylinder exhibited by the support 16 on the side facing toward the bearing surface 1. In the example depicted, the two rollers 17 have a diameter smaller than the diameter of the bearing surface 1 and are mounted on the support 16 in such a way that when the two jaws 3 and 5 are clamped against the bearing surface 1, the two rollers 17 are applied directly against the bearing surface 1 along two generatrices of the latter which are spaced apart by a circumferential angle of the order of 90°.

The jaw 5 further carries two measuring pads 18 which are fixed, on either side of the reaction support 16, on axles 19 parallel to the axis of the bearing surface so that they can be moved apart and brought together in order to be pressed, in diametrically opposed positions, against the bearing surface 1 to be machined.

Figure 2:
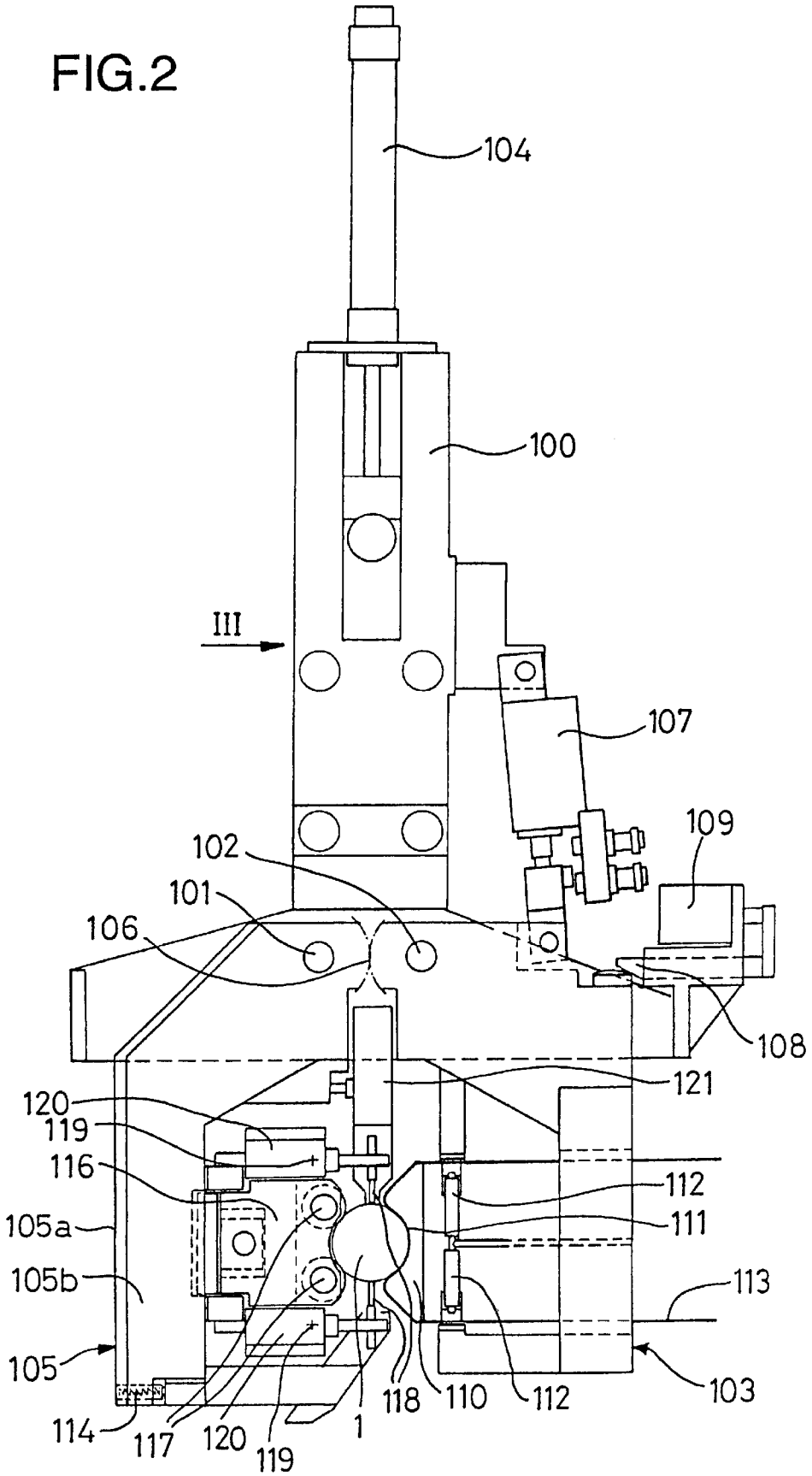
FIG. 2 shows a second embodiment of the invention adapted for use on a workpiece having substantially vertical orientation.
Figure 3:
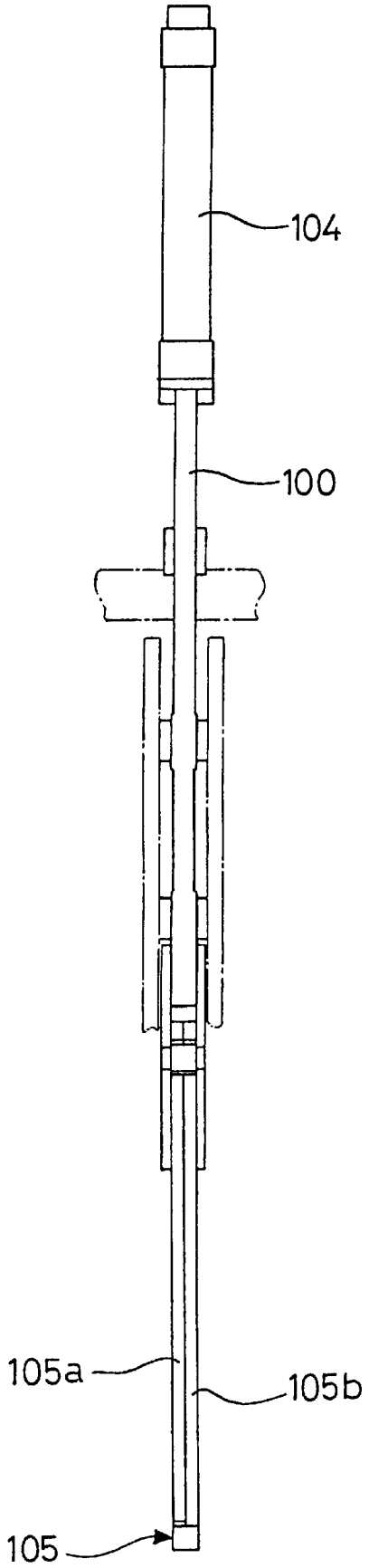
FIG. 3 is a view according to the directional arrow III of FIG. 2.

The machining assembly as illustrated in FIGS. 2 and 3 has an overall structure which corresponds to that of the machining assemblies of the machine according to document FR-A-2 636 877 (=U.S. Pat. No. 5,058,25).

Two jaws 103 and 105 are mounted so that they can pivot about axes 101 and 102 on a common support 100, the assembly being balanced by a ram 104. The layout is chosen so that the jaws 103 and 105 can be moved apart and brought together with a view to clamping against the bearing surface 1 to be machined by movement of the jaws 103 and 105 in a plane substantially perpendicular to the vertical orientation of the workpiece. In the embodiment of FIG. 1, the jaws 3 and 5 are moved in a plane substantially perpendicular to the horizontal orientation of the workpiece. These movements are controlled by a ram 107 acting on the jaw 103, the two jaws 103 and 105 being coupled by pinions 106. A locking system comprising a ramp 108 which interacts with the jaw 105 under the action of a ram 109 is provided for locking the two jaws 103 and 105 irreversibly in the clamped position.

The first jaw 103 carries a shoe 110 which, on the side facing the bearing surface 1 to be machined, has a rigid concave bearing surface 111 in the shape of a sector of a cylinder of a shape that matches that of the bearing surface 1 to be machined.

On either side of the shoe 110, the jaw 103 carries a device 112 for clamping an abrasive strip 113 which, paid out from a supply, not depicted, passes via the first clamping device 112, over the bearing surface 111 of the shoe 110, via the second clamping device 112 and is then rewound onto a winding-on device, not depicted.

The second jaw 105 consists of two part jaws 105*a* and 105*b* juxtaposed (see, in particular, FIG. 3). The part jaw 105*a* is coupled (pinions 106) to the jaw 103, while the part jaw 105*b* is driven by the jaw 105*a*, passing via a spring 114.

The part jaw 105*a* carries a reaction support 116 comprising two reaction rollers 117 mounted so that they can rotate on the support 116, their axes being parallel to the axis of the bearing surface 1 to be machined. The two rollers 117 are spaced apart in such a way as to be pressed against the bearing surface 1 to be machined along two generatrices thereof which are spaced apart by a circumferential angle smaller than 90°, in this case an angle of the order of 75°.

The part jaw 105*b* carries two measuring pads 118 mounted so that they can be pivoted about axes 119 parallel to the axis of the bearing surface 1 so as to be parted from one another and brought closer together with a view to them being applied, in diametrically opposed positions, against the bearing surface 1 to be machined. The movements of parting the reaction pads 118 and bringing them closer together again are produced by actuating means 120 controlled as a function of the clamping and unclamping movement of the jaws 103, 105. A similar actuating means is provided for the embodiment of FIG. 1. This actuating means is provided for separation of the pads or measuring tips 18 by pivoting about the axles 19 when the jaws 3 and 5 are not clamped and bringing the pads 18 closer together when the jaws are clamped. The actuating means can be activated directly by the opening and closing movement of the jaws.

Furthermore, the support 100 caries a stop 121 against which the part jaw 105*b*, driven by the part jaw 105*a*, will bear when the two jaws 103, 105 are clamped, the stop 121 thus defining the position in which the two measuring pads 110 will press against the bearing surface 1 to be machined.

This ensures that the measuring pads 118 carried by the part jaw 105*b* are independent of the reaction support 116 carried by the part jaw 105*a*, and makes it possible accurately to adjust the position of the measuring pads 118 in such a way that the latter lie exactly across the diameter of the bearing surface 1 to be machined, when they are in contact therewith.

It goes without saying that the embodiments depicted and described have been given merely by way of illustrative examples and that numerous modifications and alternative versions are possible within the scope of the invention. This goes not only for the overall structure of the machining assembly, but also, for example, for the angle over which the abrasive strip 13, 113 is pressed against the bearing surface 1 by the shoe 10, 110 of the first jaw 3, 103, which angle is advantageously between about 120° and less than 180°, and for the angle separating the two generatrices along which the reaction rollers 17, 117 contact the bearing surface 1, it being possible for this angle preferably to be between about 60° and 120°.

Furthermore, the rollers 17, 117 could be replaced by bearing surfaces or non-rotating pads, in the form of shoes, although rollers do make it possible to reduce the friction with the bearing surface 1 during rotation.

It should also be pointed out that the reaction rollers 17, 117 (or the non-rotating reaction pads) may be able to move in terms of axial translation relative to the jaw 5, 105, this being in order to allow them to follow the oscillatory movement in terms of axial translation experienced by the bearing surface 1 as it is machined by the abrasive strip 13, 113, in addition to its rotation, as is well known in abrasive machining, particularly superfinishing. Another possibility would be to make it possible for the jaw 5, 105 to move axially relative to the jaw 3, 103, and to contrive for it to "dig into" the crankshaft, between the two parts that delimit the bearing surface 1 to be machined, so that the rollers 17, 117 would be driven directly by the workpiece to be machined in its oscillatory movement of axial translation.

Finally, the abrasive strip 13, as depicted in FIG. 1, instead of being paid out from a supply 14 and immobilized by the clamping devices 12 on the bearing surface 11 of the shoe 10, could just as easily, for example, be an abrasive strip with one adhesive face so that it can be immobilized by sticking to the bearing surface 11.

We claim:

1. A machining assembly utilizing a strip of an abrasive material for machining cylindrical bearing surfaces, comprising:

first and second pivotal jaws opposing each other;

a flexible strip of an abrasive material;

clamping means for clamping said jaws at a bearing surface to be machined, so as to apply said strip of the abrasive material against said bearing surface while said bearing surface is rotated about its longitudinal axis;

said first jaw containing a shoe element with a substantially rigid pressure surface, said pressure surface having a concave configuration substantially repeating a sector of the bearing surface to be machined;

said second jaw carrying two reaction members extending substantially parallel to the axis of said bearing surface to be machined, said reaction members are spaced apart in the circumferential direction from said bearing surface in such a manner that said first and second jaws are clamped on said bearing surface; said shoe element presses said strip of abrasive material against said bearing surface, said reaction members are pressed against said bearing surface;

two measuring tips for measuring said bearing surface movably mounted on said second jaw in such a manner that said measuring tips are moved apart and brought closer together to be applied at diametrically opposed positions against said bearing surface; and displacement means for moving said two measuring tips in such a manner that said tips are spaced from said bearing surface when said jaws are unclamped and are brought together and applied against said bearing surface when said jaws are clamped.

2. The assembly according to claim 1, wherein said reaction members are rollers each having an axis of rotation substantially parallel to the axis of said bearing surface.

3. The assembly according to claim 2, wherein said reaction rollers have a diameter smaller than the diameter of said bearing surface.

4. The assembly according to claim 2, wherein said reaction rollers are movable along their axes with respect to said second jaw.

5. The assembly according to claim 2, wherein said second jaw comprises a first portion carrying said reaction members and a second portion carrying said measuring tips, said second portion is driven by said first portion by means of a spring in the direction of clamping of said jaws, the assembly further comprising a stop member for said second portion defining with respect to the bearing surface to be machined a position in which the measuring tips when brought closer together are applied against the bearing surface in the clamped position of the jaws.

6. The assembly according to claim 1, comprising a locking device adapted for locking the first and second jaws in the clamped position.

7. The assembly according to claim 1, wherein said concave pressure surface of the shoe element is in the shape of a sector of a cylinder extending over a circumferential angle between 120° and 180°.

8. The assembly according to claim 1, wherein said reaction members are pressed directly against said bearing surface along two sides of a sector, said sides are spaced apart by a circumferential angle extending between 60° and 120°.

* * * * *

UNITED STATES PATENT AND TRADEMARK OFFICE

CERTIFICATE OF CORRECTION

PATENT NO. : 5,984,767
DATED : November 16, 1999
INVENTOR(S) : Pineau et al.

It is certified that error appears in the above-identified patent and that said Letters Patent is hereby corrected as shown below:

Title page,
Insert Item -- [30] Foreign Application Priority Data
January 30, 1997 (FR) ---------- 97 01014 --

Signed and Sealed this

Fourth Day of March, 2003

JAMES E. ROGAN
*Director of the United States Patent and Trademark Office*